United States Patent [19]

Augustin

[11] Patent Number: 5,063,900

[45] Date of Patent: Nov. 12, 1991

[54] MECHANICAL SPEED GOVERNOR FOR A FUEL INJECTION PUMP OF AIR-COMPRESSING AUTO-IGNITION INTERNAL COMBUSTION ENGINES

[75] Inventor: Ulrich Augustin, Kernen, Fed. Rep. of Germany

[73] Assignee: Mercedes-Benz AG, Fed. Rep. of Germany

[21] Appl. No.: 621,977

[22] Filed: Dec. 4, 1990

[30] Foreign Application Priority Data

Jan. 23, 1990 [DE] Fed. Rep. of Germany ..... 4001789

[51] Int. Cl.[5] ..... F02D 31/00

[52] U.S. Cl. ..... 123/373; 123/367; 123/365

[58] Field of Search ..... 123/373, 372, 364, 365, 123/366, 367, 368, 369, 370, 371, 374

[56] References Cited

U.S. PATENT DOCUMENTS

| | | | |
|---|---|---|---|
| 2,281,222 | 4/1942 | Baierlein | 123/374 |
| 3,217,700 | 11/1965 | Huse | 123/373 |
| 3,620,199 | 11/1971 | Kuhn | 123/374 |
| 3,797,470 | 3/1974 | Beck | 123/368 |
| 4,204,510 | 5/1980 | Ritter | 123/366 |
| 4,308,833 | 1/1982 | Makino | 123/368 |
| 4,353,340 | 10/1982 | Straubel | 123/369 |
| 4,461,256 | 7/1984 | Lehmann | 123/367 |
| 4,690,115 | 9/1987 | Gonlogue | 123/367 |

FOREIGN PATENT DOCUMENTS

| | | | |
|---|---|---|---|
| 2334729 | 1/1975 | Fed. Rep. of Germany | 123/373 |
| 2446903 | 4/1975 | Fed. Rep. of Germany | 123/373 |
| 2656261 | 6/1978 | Fed. Rep. of Germany . | |
| 2838919 | 3/1980 | Fed. Rep. of Germany . | |
| 3901722 | 11/1989 | Fed. Rep. of Germany | 123/368 |
| 1200960 | 12/1959 | France | 123/373 |
| 0158523 | 12/1979 | Japan | 123/369 |
| 237710 | 8/1925 | United Kingdom | 123/373 |

OTHER PUBLICATIONS

Technische Unterrichtung–Diesel–Einspritzausgüstung Drehzahlregler für Reiheneinspritz pumpen, Sep. 1975.

*Primary Examiner*—Carl Stuart Miller

*Attorney, Agent, or Firm*—Evenson, Wands, Edwards, Lenahan & McKeown

[57] ABSTRACT

A mechanical speed governor for a fuel injection pump of air-compressing auto-ignition internal combustion engines has a stop bracket effecting the release of the starting quantity and limiting the full-load quantity, a flyweight arrangement with integrated positive adaptation acting in the upper speed range and a rocker lever which is in effective connection with the flyweight arrangement. The stop bracket is shifted from a position corresponding to the full-load speed. The rocker lever alters the control travel of the quantity control member for full load via the stop bracket and a counterstop connected to the quantity control member, and effects a negative adaptation in the lower speed range.

3 Claims, 1 Drawing Sheet

MECHANICAL SPEED GOVERNOR FOR A FUEL INJECTION PUMP OF AIR-COMPRESSING AUTO-IGNITION INTERNAL COMBUSTION ENGINES

BACKGROUND AND SUMMARY OF THE INVENTION

The present invention relates to a mechanical speed governor for a fuel injection pump of air-compressing auto-ignition internal combustion engines, the fuel injection pump having a quantity control member.

In speed governors (so-called RQ governors), it is customary to limit the travel of the quantity control member of the fuel injection pump by stops for the full-load quantity and for the starting quantity. Furthermore, it is customary to provide these speed governors with flyweight arrangements having an adaptation device which effects positive adaptation (reduction of the fuel quantity with increasing speed in the upper speed range).

In a known speed governor, a swivellably designed bracket having a full-load stop can be shifted as a function of the speed from a position corresponding to the starting position to a position corresponding to the full-load position in order to limit the adjustment travel of the quantity control member. In this arrangement, the adaptation device has the task of displacing the quantity control member towards a reduced quantity in the case of high speeds (cf. the publication "Bosch Technische Unterrichtung, Drehzahlregler fur Reheneinspritzpumpen, 1st Edition, Sept. 30, 1975, pages 19 and 38).

A speed governor design of this type permits an adaptation of the delivery characteristic of the injection pump to the fuel requirement characteristic of the internal combustion engine in the upper speed range.

German Patent Document DE-OS 2,838,919 discloses a speed governor for internal combustion engines in which the articulated fork of the quantity control member has a counterstop for the full-load stop of the bracket, and while this counter stop is part of an adaptation device, this design has an expensive construction having a spring-loaded slider corresponding in its positive adaptation effect to that in the flyweights of the flyweight arrangement described earlier.

German Patent Document DE 26 56 261 C2 discloses a speed governor in which, although a full-load stop slides along a stop track, borne by the counterstop, for the negative adaptation, the counterstop is arranged firmly screwed on the governor housing.

An object of the invention is to provide a speed governor, in addition to the positive adaptation, by low-cost constructional measures, with a negative adaptation in the speed range below the positive adaptation. This makes possible improved fitting of the delivery quantity in the entire load range to the fuel requirement of the internal combustion, in particular with the aim of more favorable behavior as regards smoke.

This and other objects are achieved by the present invention which provides a mechanical speed governor for a fuel injection pump of air-compressing, auto-ignition internal combustion engines, the fuel injection pump having a quantity control member, the governor comprising a flyweight arrangement with an adaptation device effecting positive adaptation. The governor includes an articulated fork having a counterstop, this articulated fork being coupled to the quantity control member, and a bracket having a full-load stop. The bracket is shiftable between a starting position corresponding to a starting speed and a full-load position corresponding to a full-load speed such that the full-load stop interacts with the counterstop on the articulated fork. A spring-loaded rocker lever is coupled to the bracket, this rocker lever shifting the bracket between the starting position and the full-load position as a function of speed. The counterstop includes a stop track on which the full-load stop slides as a function of speed, this stop track effecting a negative adaptation.

The present invention provides a counterstop fixed to the articulated fork only with one, special stop track, which does not impair the releasing or enabling of the starting quantity, along which the full-load stop of the swivellable bracket slides under speed control. By this design, an adaptation is provided which is negative in the lower speed range and operates independently of the positive adaptation acting in the upper speed range. Also, the behavior of the internal combustion engine is considerably improved with respect to smoke in a relatively simple manner.

Other objects, advantages and novel features of the present invention will become apparent from the following detailed description of the invention when considered in conjunction with the accompanying drawings.

DETAILED DESCRIPTION OF THE DRAWINGS

Figure 1:
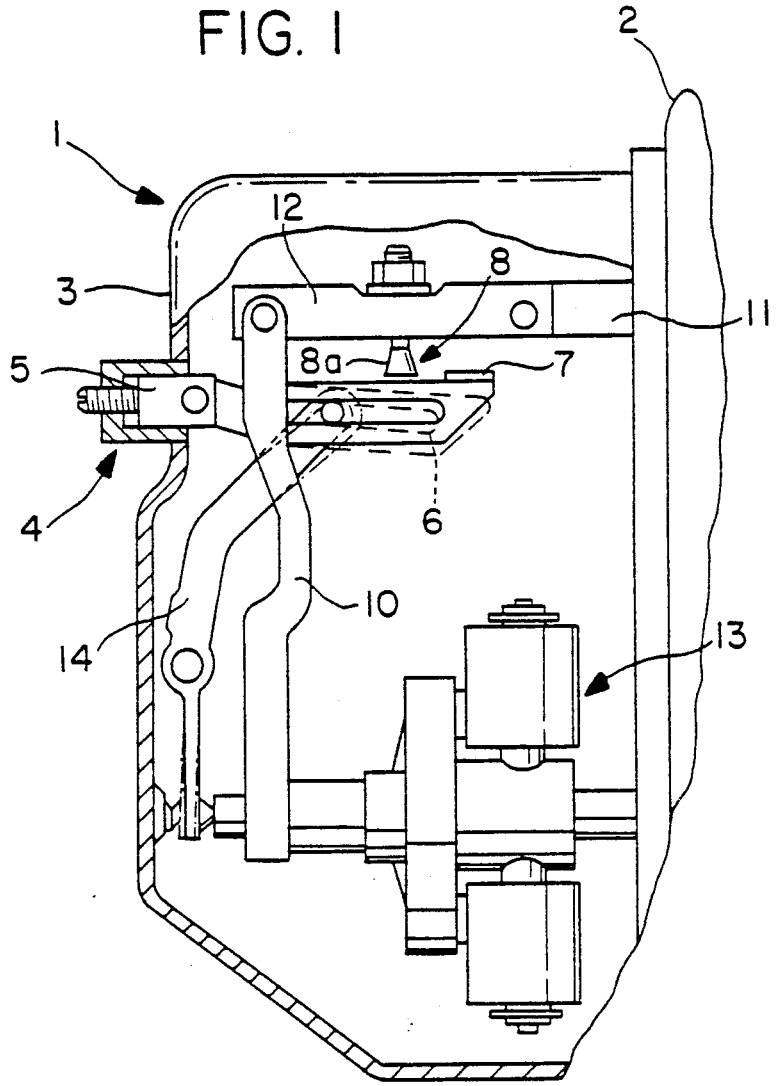
FIG. 1 shows a section through a mechanical speed governor constructed according to an embodiment of the present invention, only part of which is illustrated.
Figure 2:
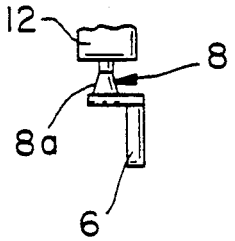
FIG. 2 shows a side view of a bracket with full-load stop.

FIG. 1 shows a mechanical speed governor as an attachment to a fuel injection pump 2 provided for air-compressing, auto-ignition internal combustion engines. Fixed to a front housing part 3 of the speed governor 1 is a full-load quantity adjusting device 4. Articulated on the full-load quantity adjusting device 4 is a adjusting slide 5 having a bracket 6 that projects into the speed governor 1, this bracket 6 having a full-load stop 7. The bracket 6 is effectively connected with a counterstop 8, which is an adjustable bolt that is secured in an articulated fork 12. The articulated fork 12 connects a control lever 10 to a quantity control member 11 in such a way that the control lever 10 is longitudinally displaceable transversely to the direction of movement of the fork 12. A bolt portion 8*a* protrudes from the articulated fork 12 and is conical. That part of the cone of the bolt portion 8*a* which is of larger diameter is turned towards the bracket 6. Bolt portion 8*a* acts as a stop track, along which the full-load stop 7, situated at right angles to the section plane of the speed governor 1 (FIG. 2), slides in the lower speed range with the effect of a negative adaptation. Adaptation is initiated by the flyweight arrangement 13 of the speed governor 1, this flyweight arrangement 13 swivelling the bracket 6 as a function of speed via a spring-loaded rocker lever 14.

The flyweight arrangement 13 is already equipped with an adaptation device in the flyweights (not shown), by means of which a positive adaptation in the upper speed range is effected between $n_3$ and $n_4$.

Figure 3:
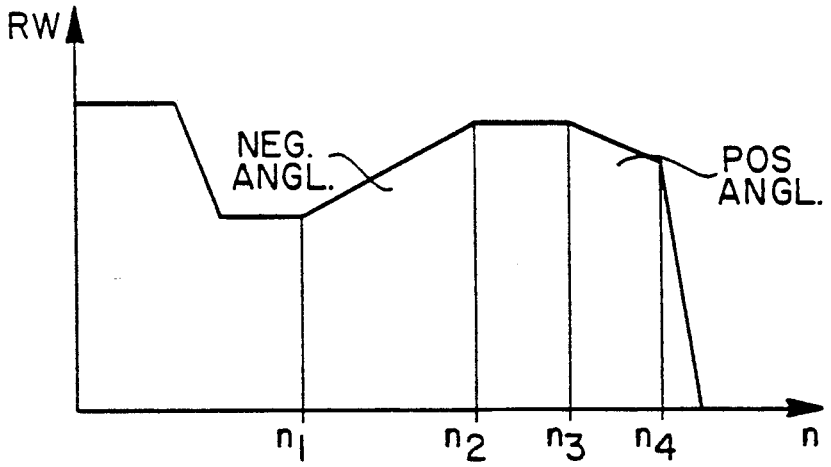
FIG. 3 shows a control travel/speed function diagram.

The adaptation path of the negative adaptation, as can be seen from FIG. 3, extends from $n_1$ to $n_2$, signifying that the bracket 6 is resting against the lower end of the conical bolt portion 8*a*. This position corresponds to the beginning of adaptation at $n_1$. As the speed increases, the bracket 6 is swivelled in the counterclockwise direction until the upper end of the conical bolt portion 8*a* has been reached, this corresponding to the end of adaptation at $n_2$ and simultaneously to an increase in the delivery quantity.

The stop track does not have to be flat but can run in accordance with the delivery-quantity requirement of the internal combustion engine, e.g. in an arc.

When the internal combustion engine is at a standstill, the bracket 6 occupies the position indicated by broken lines to enable the quantity control member 11, designed as a control rod, to occupy a starting position beyond the full-load quantity position when starting. After starting, the full-load quantity is limited by the interaction of the full-load stop 7 and counter stop 8.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A mechanical speed governor for a fuel injection pump of air-compressing, auto-ignition internal combustion engines, the fuel injection pump having a quantity control member, the governor comprising:

a flyweight arrangement with an adaptation device effecting a net positive adaptation;

an articulated fork having a counterstop, said articulated fork coupled to the quantity control member;

a bracket having a full-load stop and shiftable between a starting position corresponding to a starting speed and a full load position corresponding to a full-load speed such that said full-load stop interacts with said counterstop on said articulated fork; and a spring-loaded rocker lever coupled to said bracket, said rocker lever shifting said bracket between said starting position and said full-load position as a function of speed;

wherein said counterstop includes a stop track on which said full-load stop slides as a function of speed, said stop track effecting a net negative adaptation of the mechanical speed governor.

2. The speed governor of claim 1, wherein said counterstop is a conical bolt which passes through said articulated fork, a cone of the bolt tapering towards said articulated fork.

3. The speed governor of claim 2, wherein said conical bolt is adjustable.

* * * * *